US010629115B2

(12) United States Patent
Bennett

(10) Patent No.: US 10,629,115 B2
(45) Date of Patent: Apr. 21, 2020

(54) MULTIMODE ELECTRONIC DISPLAY

(71) Applicant: James Duane Bennett, Hroznetin (CZ)

(72) Inventor: James Duane Bennett, Hroznetin (CZ)

( * ) Notice: Subject to any disclaimer, the term of this patent is extended or adjusted under 35 U.S.C. 154(b) by 199 days.

(21) Appl. No.: 15/864,969

(22) Filed: Jan. 8, 2018

(65) Prior Publication Data

US 2019/0012958 A1 Jan. 10, 2019

Related U.S. Application Data

(63) Continuation of application No. 14/791,254, filed on Jul. 3, 2015, now Pat. No. 9,865,195.

(51) Int. Cl.

| | |
|---|---|
| ***G09G 3/3208*** | (2016.01) |
| ***G09G 3/34*** | (2006.01) |
| ***G09G 5/14*** | (2006.01) |
| ***G09G 3/00*** | (2006.01) |
| *G09G 3/36* | (2006.01) |

(52) U.S. Cl.

CPC ..... *G09G 3/3208* (2013.01); *G09G 3/003* (2013.01); *G09G 3/344* (2013.01); *G09G 3/3446* (2013.01); *G09G 5/14* (2013.01); *G09G 3/36* (2013.01); *G09G 2300/023* (2013.01); *G09G 2300/046* (2013.01); *G09G 2300/0426* (2013.01); *G09G 2320/0613* (2013.01); *G09G 2320/0686* (2013.01)

(58) Field of Classification Search

CPC ..... G09G 3/3208

See application file for complete search history.

(56) References Cited

U.S. PATENT DOCUMENTS

| | | | | |
|---|---|---|---|---|
| 8,013,519 | B2 * | 9/2011 | Boerner | H01L 51/524 313/504 |
| 8,760,363 | B2 * | 6/2014 | Lin | G09G 3/344 345/1.1 |
| 9,141,224 | B1 * | 9/2015 | Rowe | G06F 3/0414 |
| 2008/0007486 | A1 * | 1/2008 | Fujinawa | G02F 1/1347 345/5 |
| 2008/0049005 | A1 * | 2/2008 | Okita | G09G 3/3648 345/207 |
| 2011/0043435 | A1 * | 2/2011 | Hebenstreit | G02B 26/005 345/5 |
| 2011/0050545 | A1 * | 3/2011 | Namm | G09G 3/20 345/5 |
| 2011/0109568 | A1 * | 5/2011 | Wu | G06F 3/0412 345/173 |

(Continued)

*Primary Examiner* — Jason C Olson

(57) ABSTRACT

A system comprises a first display driver interface circuit configured to receive a plurality of software control instructions regarding a display device, and a second display driver interface circuit configured to deliver a first control signal to a display device in response to a first of the plurality of software control instructions, and to deliver a second control signal to the display device in response to a second of the plurality of software control instructions. The first control signal directs at least a portion of the display device into a light emitting mode when pixel data to be displayed by that portion of the display device is variable over a determined number of consecutive frames, and the second control signal directs at least a portion of the display device into an electronic paper mode when pixel data to be displayed by that portion of the display device is fixed over the determined number of consecutive frames.

16 Claims, 13 Drawing Sheets

IN OLED DISPLAY MODE
Front View

(56) References Cited

U.S. PATENT DOCUMENTS

| | | | | |
|---|---|---|---|---|
| 2011/0134156 | A1* | 6/2011 | Yamazaki | G02F 1/167<br>345/690 |
| 2012/0127140 | A1* | 5/2012 | Ryan | G09G 3/3648<br>345/207 |
| 2012/0214412 | A1* | 8/2012 | Schlub | G01B 7/023<br>455/41.1 |
| 2012/0299816 | A1* | 11/2012 | Lee | G02F 1/133528<br>345/156 |
| 2015/0228217 | A1* | 8/2015 | Perdices-Gonzalez | G09G 3/348<br>345/5 |

* cited by examiner

IN COLOR ELECTRONIC PAPER DISPLAY MODE

MIXED MODE EPD & OLED SANDWICH

MULTIMODE ELECTRONIC DISPLAY

PRIORITY CLAIM/INCORPORATION BY REFERENCE

This application is a continuation of U.S. patent application Ser. No. 14/791,254 filed on Jul. 3, 2015. The above referenced application is hereby incorporated herein by reference.

BACKGROUND

Conventional displays include many types such as OLED (Organic Light Emitting Diode), LCD (Liquid Crystal Display), and EPD (Electronic Paper Display). Some of such display types may exhibit inherent advantages over other types for one particular application but not for others. For example, EPD's may offer lower power, better performance in direct sunlight, and image persistence when powered down. OLED's might offer better color and low-lighting performance. Manufacturers of display devices select from all display types to favor particular primary features and applications at the detriment of other secondary features and applications.

Other limitations and disadvantages of conventional and traditional electronic display technologies will become apparent to one of skill in the art, through comparison of such systems with some aspects of the present invention as set forth in the remainder of the present application with reference to the drawings.

BRIEF SUMMARY OF THE INVENTION

Systems methods are provided for a multimode display, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Various approaches to integrating two or more display technologies into a single display can be found below. Some carry out integration via merger (e.g., FIG. 1A) while others may be carried out via stacking (e.g., FIG. 5A). Although not shown, integration may be carried out by a combination of both merging and stacking, for example where three or more display technologies are desired within a single display.

Figure 1A:
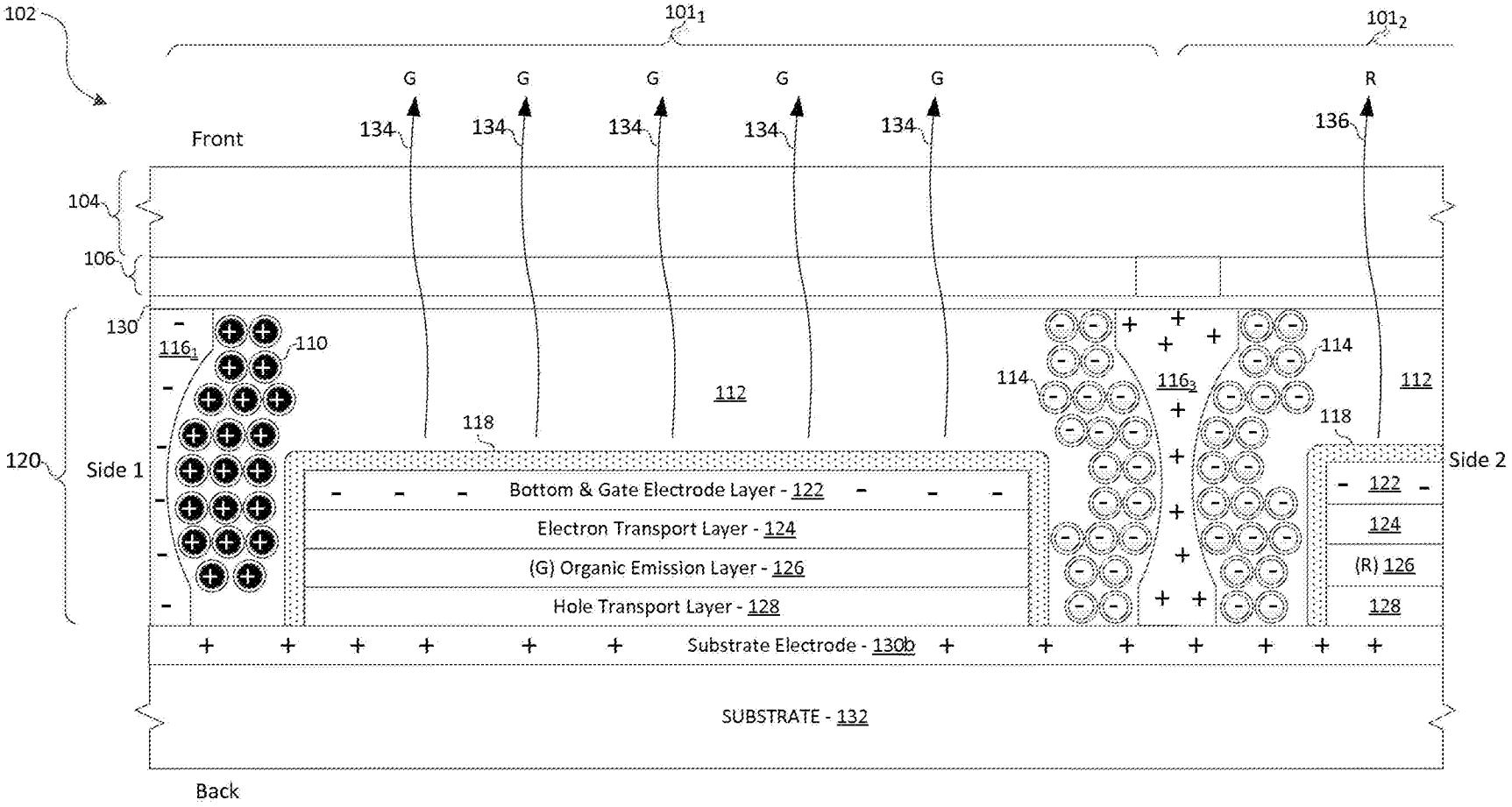
FIG. 1A illustrates a side view of an example multimode display an in emissive/absorptive mode of operation.

FIG. 1A illustrates a side view of an example multimode display an in emissive/absorptive mode of operation. The multimode display assembly 102 comprises a plurality of pixels (or subpixels, for a multicolor implementation; both pixels and subpixels are referred to herein as simply "pixels") 101, of which first one, $\mathbf{101}_1$, is completely shown and a second one, $\mathbf{101}_2$, is partially shown. Proceeding from the front of the display assembly 102 to the back, it comprises a transparent (optionally flexible) cover 104, a transparent electrode 106, a sealing/protective layer 130, a pixel cavity layer 120, a substrate electrode 130*b*, and a (optionally flexible) substrate 132.

The transparent cover 104 is made of glass, plastic, or other transparent material.

The electrode 106 is made of a transparent conductive and/or semiconductor material (and/or any opaque portions are microscopic so as not to substantially affect view of the display 104). The electrode 106 may be a passive or active such that different portions of the electrode 106 in front of different pixels may concurrently have different charges. The sealing/protective layer 130 adheres the electrode to the display assembly 102 and seals the fluid inside the pixel cavity layer 120. The electrode 130*b* may be passive such that any charge applied to it is distributed substantially uniformly across all pixels it is behind, or may be an active device such as an array of thin film transistors such that different portions of the electrode 130*b* behind different pixels may concurrently have different charges. The (optionally flexible) substrate 132 provides structural support to the display assembly 102. The pixel cavity layer 120 comprises pixel walls 116, an organic light emitting diode (OLED) "stack" (electrode layer 122, electron transport layer 124, organic emission layer 126, and a hole transport layer 128) sealed by transparent layer 118, and a plurality of positively charged black particles 110 and negatively charged white particles 114 in a transparent fluid 112.

The walls 116 provide structural support and also are made of a conductive or semiconductor material that can be charged to a desired potential. Charge placed on the walls 116 may be used for controlling the location of the particles 110 and 114, as described below. Although concave cavities in the walls 116 are shown as an example, other shapes may be used. For example, the walls 116 may have a triangular cross section. The pixel walls may, for example, be stalactite and/or stalagmite type constructs with conductive adhesives.

Figure 1B:
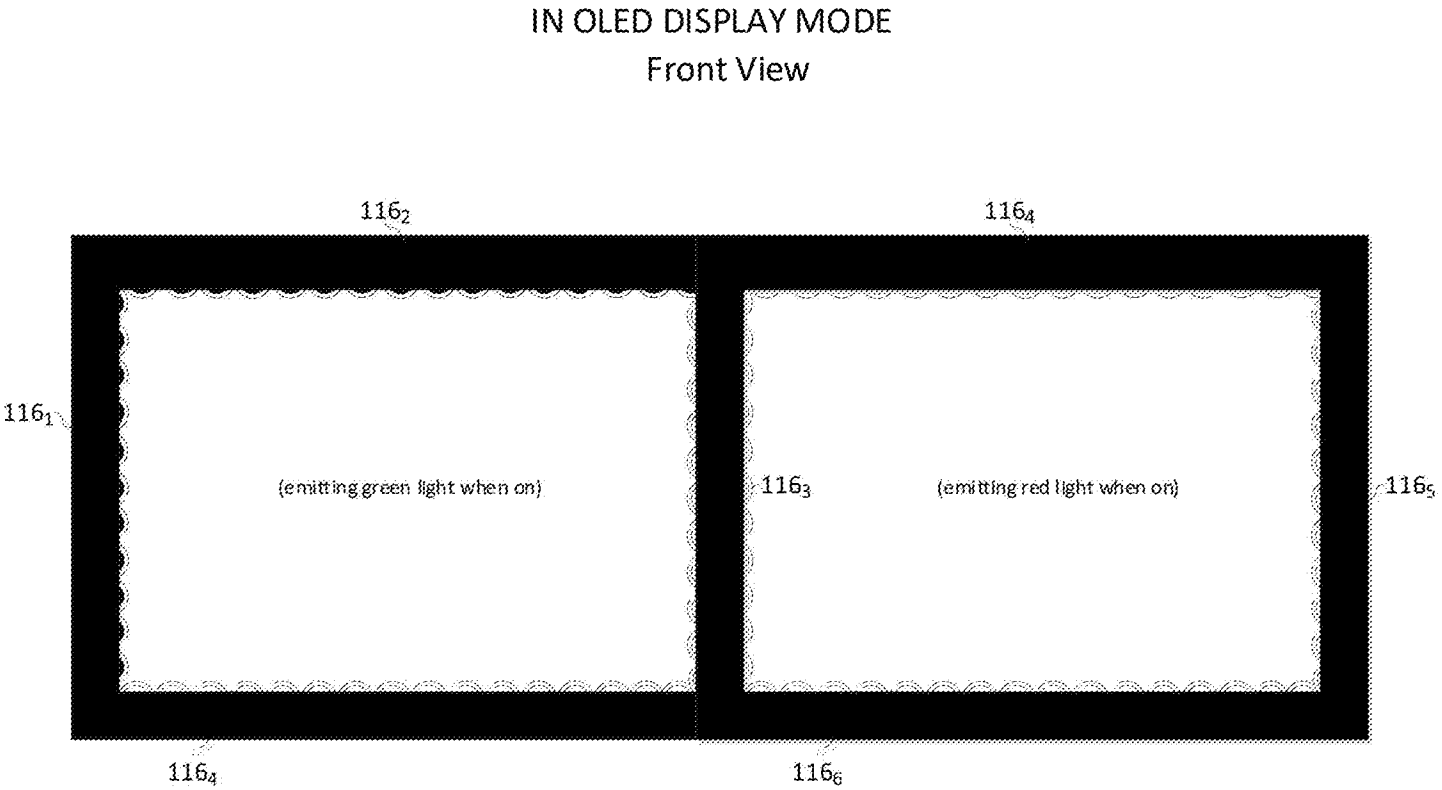
FIG. 1B illustrates a front view of an example multimode display an in emissive/absorptive mode of operation.

To operate in OLED mode (an example of an emissive/absorptive mode), as shown in FIGS. 1A and 1B, drive signals are applied to the walls 116 to cause the particles 110 and 112 to be pulled through the fluid 112 into cavities in the walls 116, where the particles 110 and 114 are stored such that they do not block (or block to only to a tolerable extent) light emitted by the OLED stack. The drive signals may, for example, be applied to the walls 116 passively and/or via thin film transistors (TFTs) connected to the walls 116. With the particles hidden, a pixel 101 can emit light through the cover 104 (as illustrated by arrows 134 and 136 in FIG. 1A) by applying a voltage across the electrode layer 122 and substrate electrode 130*b* (in the example shown, subpixel $\mathbf{101}_1$ emits green light and subpixel $\mathbf{101}_2$ emits red light) and can display black by removing the potential across the OLED stack thus causing the OLED stack to absorb light incident on it. When the particles 110 and 114 are pulled into the cavities in OLED mode, interactions between various charged elements (particles 110, particles 114, walls 116, electrode 106, electrode 122, and electrode 130*b*) of the same pixel 101 (intra-pixel interactions) and with other pixels 101 (inter-pixel interactions) may be managed through proper selection of the charge of the various elements, which may include duty-cycling drive signals, for example.

Figure 1C:
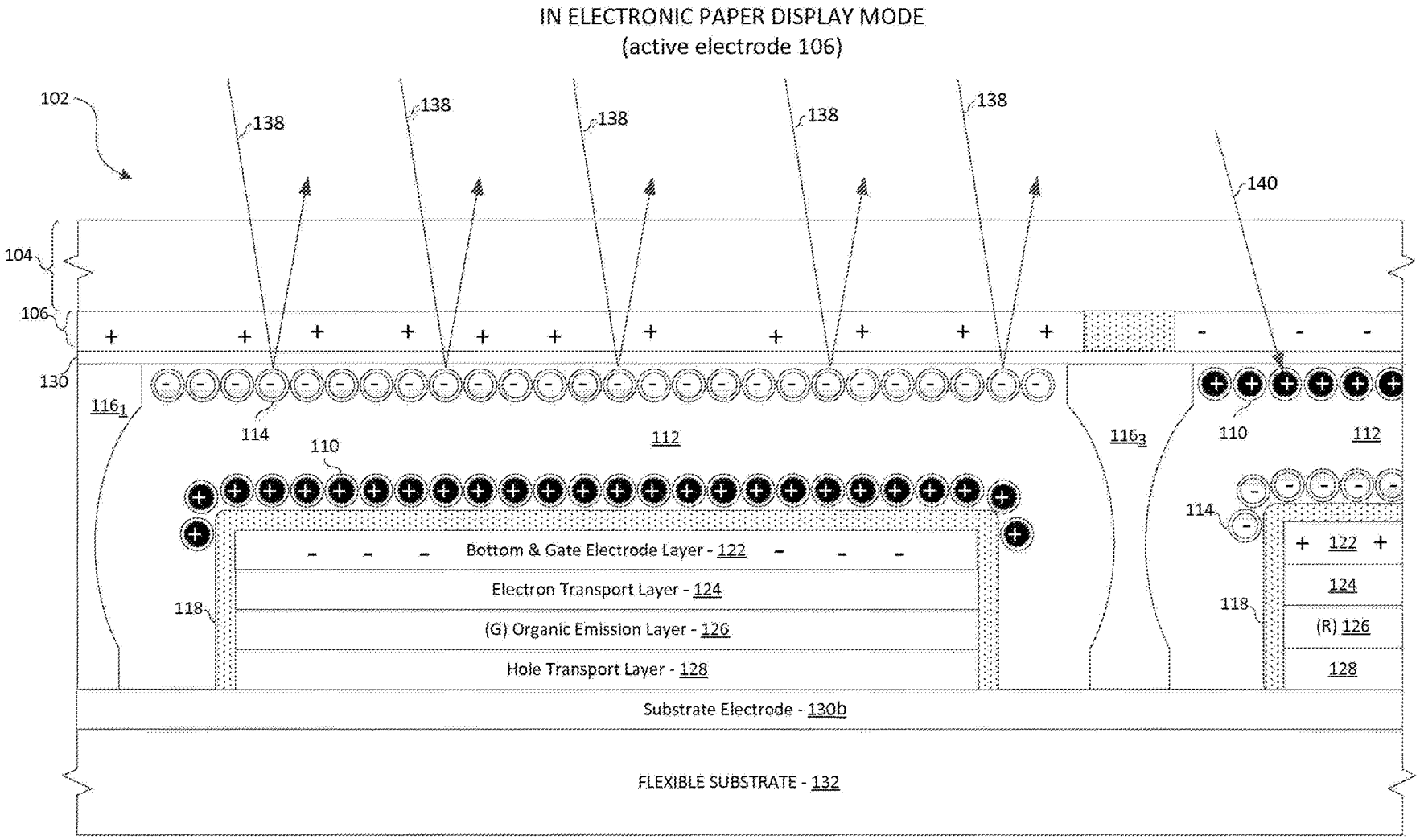
FIGS. 1C-1D illustrate a reflective/absorptive mode of operation for various example implementations of a multimode display.
Figure 1D:
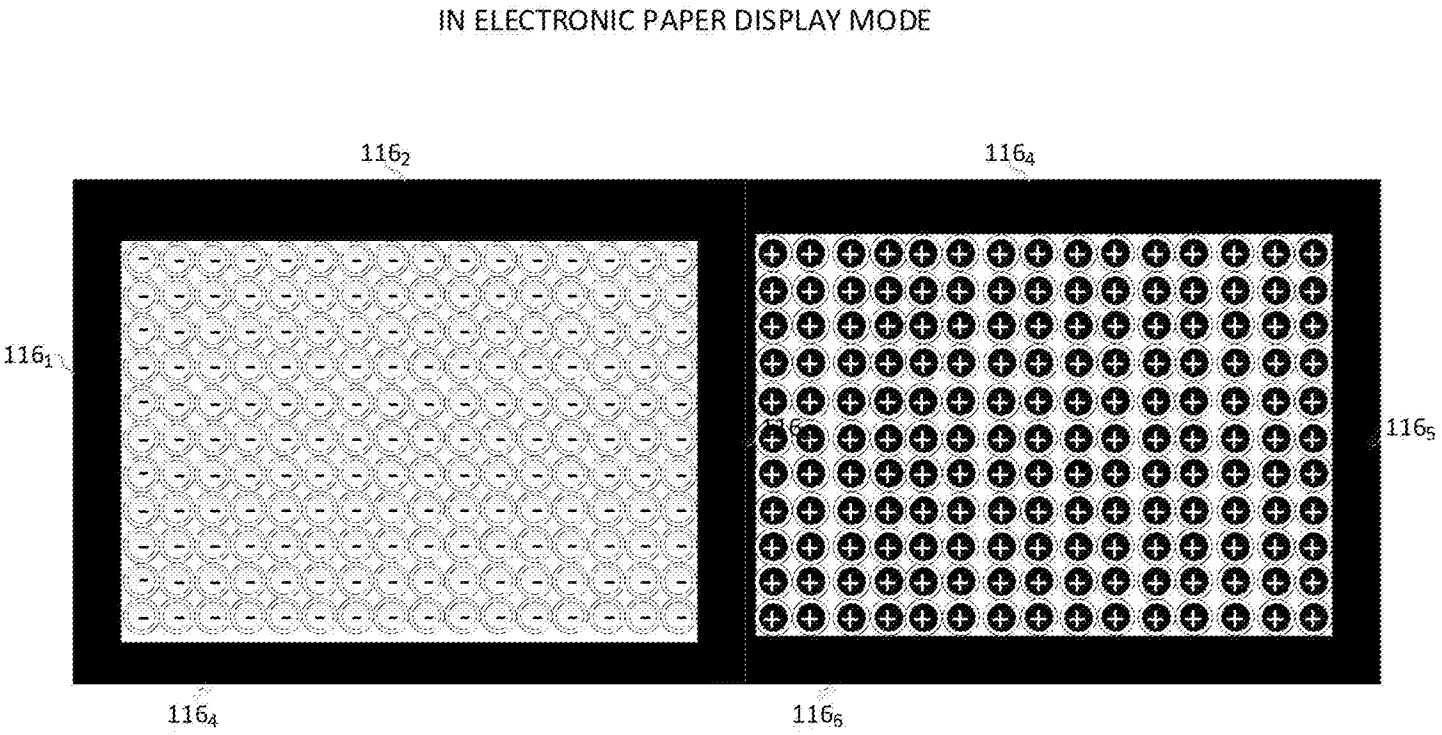

Now referring to FIG. 1C, to operate the pixels $\mathbf{101}_1$ and $\mathbf{101}_2$ in an electronic paper display (EPD) mode (an example of a reflective/absorptive mode), the OLED stack is turned off (i.e., the voltage differential between the layer 122 and 130*b* is removed), the drive signals applied to the walls 116 are removed, and an appropriate voltage differential is applied between the transparent cover electrode 106 and the gate electrode 122. In the example shown, a positive differential between 106 and 122 causes the white particles 114 to move to the front of the cavity 120 (as shown for subpixel $\mathbf{101}_1$ in FIGS. 1C and 1D) and a negative differential causes the black particles 110 to move to the front of the cavity 120 (as shown for subpixel $\mathbf{101}_2$ in FIGS. 1C and 1D).

In another example implementation, rather than separate black and white particles, bistable particles having, for example, a black positively charged surface and a white negatively charged surface may be used and the charge on the electrodes may be controlled to spin the particles such that one side or the other is facing the transparent cover. That is, the particles may be spun such that the white side is up for reflection and such that the black side is up for absorption. Similarly, particles having additional surfaces (e.g., pyramid shaped particles with four color or cubes with six colors) with additional colors on them may be used for a color EPD display.

In another example implementation, rather than black and white particles, there may be only white particles and a black state may take advantage of the absorption of the OLED stack in an off state. That is, for emissive mode and absorptive mode, the white particles 114 may be pulled to the walls 116 and for reflective mode the white particles may be pulled to the front of the cavity 112.

In principle, integration of EPD and OLED technology can encompass any display structure that operates in a first mode or configuration which permits OLED emissions from reaching a viewer's eye with little or no interference from EPD particles and structure, and that operates in a second mode or configuration which allows EPD particles to function with little or no interference from OLED structure. Merged and stacked integration approaches illustrated herein are merely several examples or approaches for doing so.

The particles 110 and 114 may be made from charged materials such as coatings (paints or dyes) or translucent or opaque plastic, for example. With such charge, the particles 110 and 114 are drawn toward and repelled from the conductive surfaces 130*b*, 118 and 116 as controlled by display driver circuitry to carry out an appropriate mode selection and pixel operational status. The walls 116 may be conductive throughout based on material selection and/or may receive a coating (e.g., conductive layer) to support same. In particular, by driving 130*b* and 118 to a common voltage while creating a voltage difference between the walls 116, the particles 110 and 114 may be "retracted" from view to permit OLED pixel mode operation.

Alternatives to the black and white particle options include using spherical particles with one half being black and the other white, and wherein the black and white particle merely flips over depending on the charged environment in relation to the black versus white, positive and negative charges. Multiple types of colored particles can also be added with corresponding structure that supports the integrated display technologies.

Figure 2:
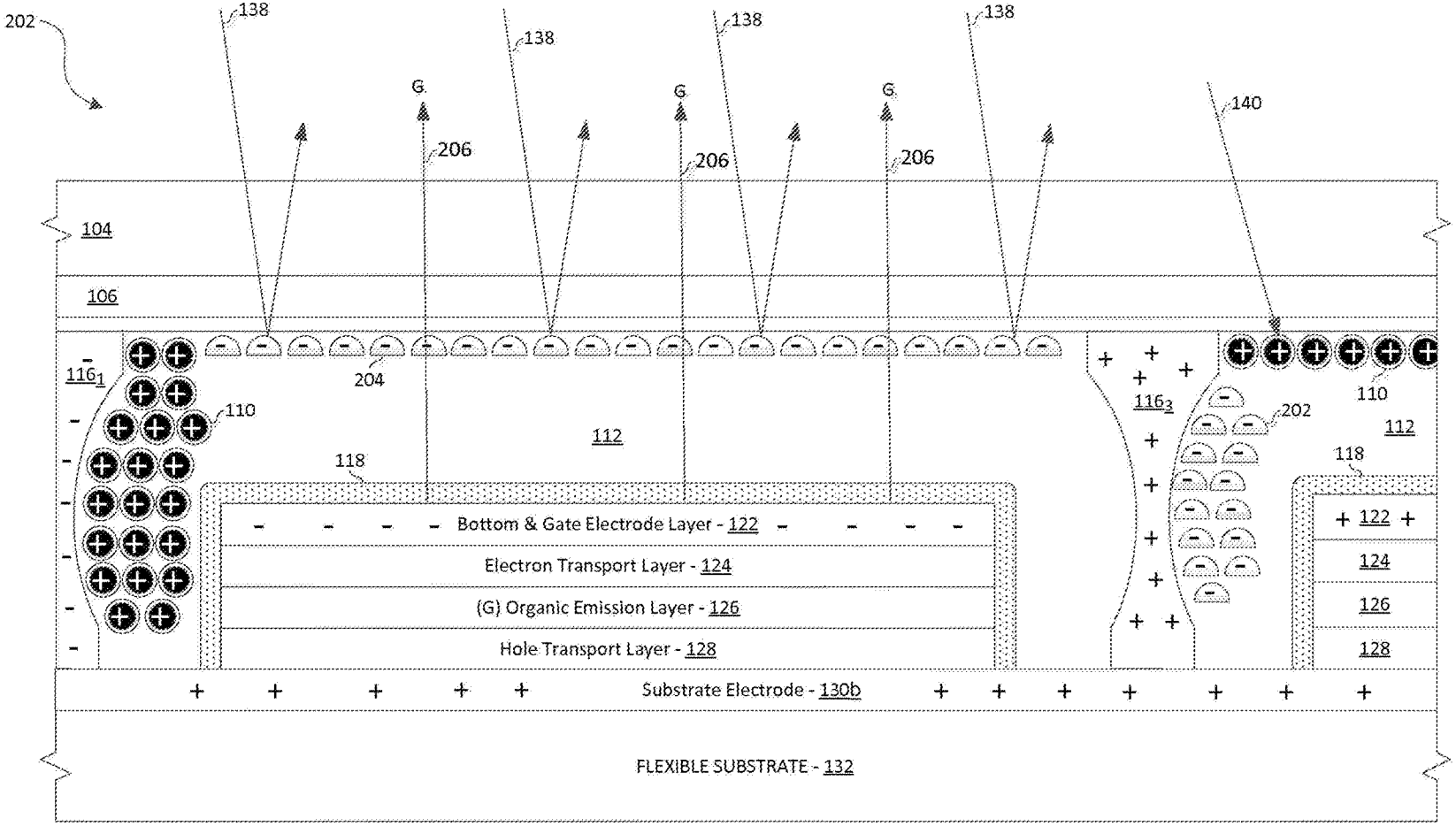
FIG. 2 illustrates a hybrid emissive/reflective and absorptive/reflective mode of operation for an example implementation of a multimode display.

FIG. 2 illustrates a hybrid emissive/reflective and absorptive/reflective mode of operation for an example implementation of a multimode display. The display assembly 202 supports three modes: OLED mode, EPD mode, and a hybrid mode in which the OLED layers emit light while EPD particles are in the path of the emitted light. FIG. 2 shows the display assembly 202 operating in this mode. The white particles 204 are transparent or semi-transparent and may act to disperse the outgoing light represented by arrows 206.

For example, the white particles 204 may be hemispheres with a white coated spherical hemisphere portion and a flat transparent portion such that light incident on the hemisphere portion is reflected, as shown by arrows 138, but light incident on the flat portion passes through the particles, as shown by arrows 206. When a pixel is white, the half spheres will be arranged to point outward to show white. But, by then turning on the OLED stack, light can be emitted that passes through the flat transparent portion of the particles 204 and then is dispersed toward a viewing eye. This will work as backlighting and also as full color performance but perhaps offer a visual characteristic much like newspaper color or watercolor and the OLED emission intensity can be adjusted to soften the color effect.

In another example implementation, the particles 204 may be lenticular lens elements such that a pixel 101 may support both a three-dimensional mode and a two-dimensional mode. That is, rather than black and white particles 110 and 114 of FIGS. 1A-1D, lenticular lens elements 204 having a charged coating may by pulled in and out of the line of sight with the OLED stack. For 2D mode, the lens elements 204 are pulled out of the pathway (hidden in cavities of the walls 116), and for 3D mode the lens elements 204 are pulled to the top electrode 106 such that light emitted by the OLED stack passes through the lens elements 204 for providing a 3D effect.

Figure 3A:
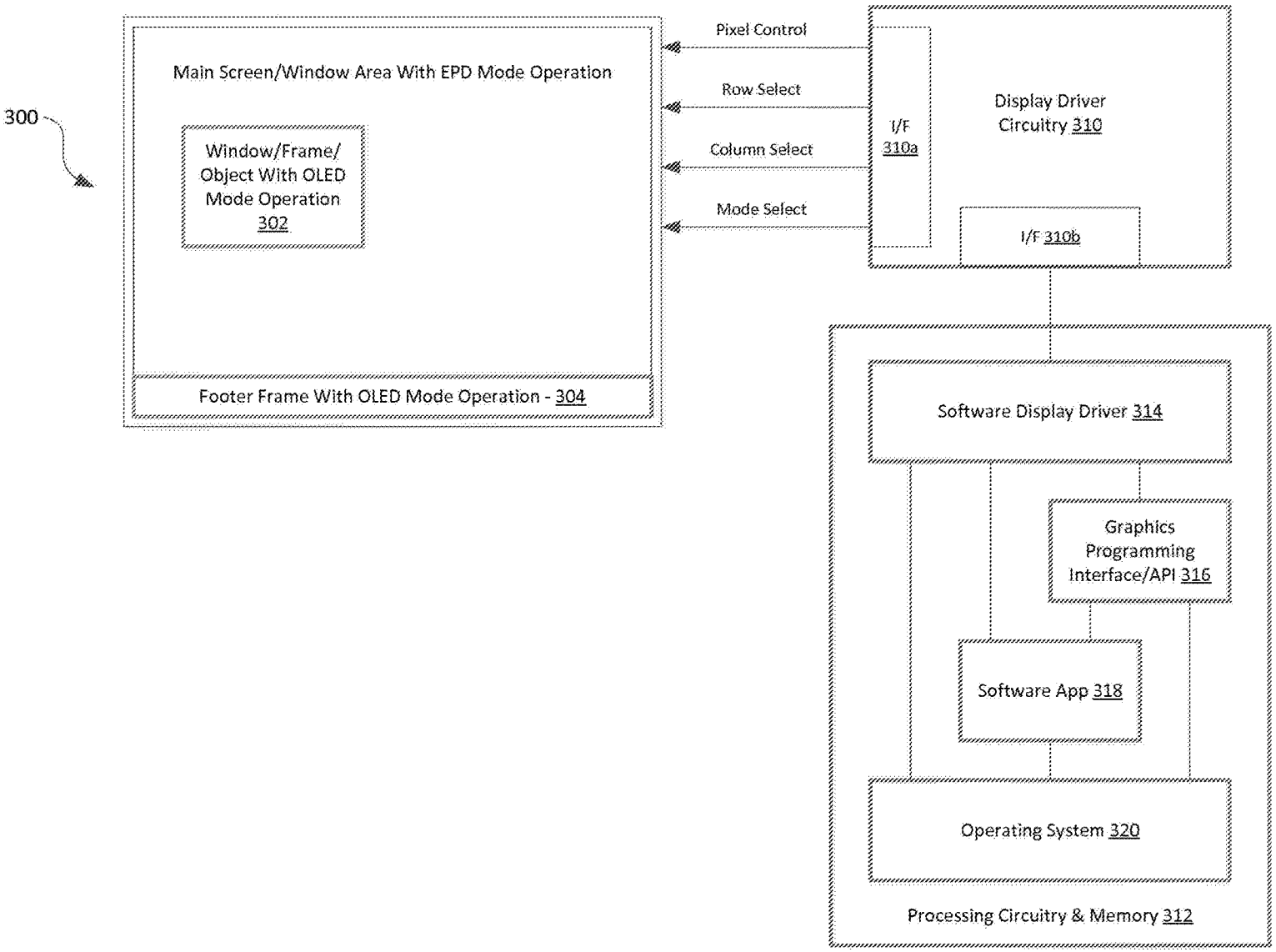
FIGS. 3A and 3B illustrate a multimode electronic display that supports concurrently operating a first one or more pixels in an emissive/absorptive mode and a second one or more pixels in an absorptive/reflective mode.

FIG. 3A shows a display device 300 in which most of the screen is in EPD mode but two windows 302 and 304 are in OLED mode. This may correspond to, for example, viewing of a website that is mostly text but has two regions (corresponding to windows 302 and 304) in which there are images and/or videos. The images/videos may be displayed in OLED mode such that they can be viewed in full color. As the viewer scrolls the website the OLED region may track the images (e.g., if the user scrolls down 10 rows of pixels, pixels in the 10 rows that were previously above the image in EPD mode switch over to OLED mode and pixels in the 10 rows that previously presented the bottom 10 rows of the picture switch over to EPD mode to present the text region that has scrolled into them).

For viewing websites on such a display that supports concurrent EPD and OLED regions, web languages and protocols (e.g., HTTP, HTML, CSS, XML, etc.) may include regional tagging to indicate whether a particular portion/object of a website should be displayed in EPD mode, OLED mode, or hybrid EPD/OLED mode. A web browser running on the client device presenting the website may be configured to recognize such tags and send commands to the appropriate display driver circuitry to configure each pixel into the appropriate mode for the current screen contents. Viewing largely text-based sites, for example, may result in huge power savings as compared to a conventional all-OLED display which needs to use emitted light for the text portions.

In other words, any of the display architectures described herein can be configured to operate fully in one mode (e.g., OLED) or fully in another (e.g., EPD). It can also be configured to carve out and allocate regions such as illustrated in FIG. 3A wherein both modes operate in concert. Such regions can be defined to be rectangular (as shown) or on a pixel by pixel basis. For example, background pixels may be operating in EPD mode while particular pixels representing a ball may be switched to OLED to simulate a bouncing motion across the background. Further, some regions and/or some pixels can be defined to operate in both modes simultaneously, e.g., where perhaps a white EPD configuration (via a somewhat translucent material selection and/or particle spacing) can add a "tint" through underlying OLED emissions.

To handle these modes switchovers, display driver circuitry 310, via interface circuitry 310*a*, provides row and column scanning signaling to select a particular pixel that is placed in a particular operational mode via mode select signaling. A mode select signal may, for example, comprise a command delivered over a control bus (e.g., $I^2C$, PCIe, HDMI, or the like) between the interface 310*a* and the display device 300, and the circuitry for interpreting the commands and generating the corresponding bias signals to the walls 116, and electrodes 106, 122, and 132. A mode select signal may, for example, comprise a DC voltage or an AC voltage (e.g., pulse width modulated square wave or sinusoid) delivered over one or more dedicated conductors between the between the interface 310*a* and the display device 300 (e.g., where relatively large regions of pixels are controlled together such that the number of such conductors is not too large). Pixel control signaling (via the interface circuitry 310*a*) may then set the state or condition of such selected pixel. Processing circuitry and associated memory 312 work in concert to deliver instructions via interface circuitry 310*b* to the display driver circuitry 310 to carry out such functionality. Thus, each pixel can be set to a particular one or more modes of operation and set to a particular display state in a scanning manner (where each vertical scan of the display may be referred to as a "field" or "frame"). Mode reconfiguration may, for example, take place during the vertical blanking interval, such that the mode of any particular pixel may be altered on a per-field or per-frame basis. Alternatively, where reconfiguration takes slightly longer, a pixel may be skipped during one or more fields or frames, but the loss of only a few fields or frames is likely unnoticeable to a viewer.

The processing circuitry & memory 312 operate pursuant to various software instructions (stored in such memory) such as that illustrated. For example, a software display driver 314 may be loaded into memory to provide processing instructions regarding how to manage each particular pixel (mode, setting, etc.). Instructions from the driver 314 to operate a particular pixel in a reflective mode may include a reflective mode selecting identifier for that pixel, and instructions from the driver 314 to operate a particular pixel in a reflective mode may include a reflective mode selecting identifier for that pixel. An operating system 320 might then interact directly via the software display driver 314 to cause, for example, only a small rectangular screen area representing a pop-up window to operate in an EPD mode while the remainder operates in OLED mode.

For more complex graphical tasks, a graphics programming interface or API (Application Programming Interface) 316 might also be loaded into memory which manages advanced graphical instructions to control the display 300. The operating system 320 might then send an API defined library function or command to draw a circle at a particular location with a particular size and using a selected operational mode (e.g., EPD). The API 316 also services software applications 318. Such software applications 318 may also interact directly with the software display driver 314 to carry out pixel, region or full-screen control and associated operational mode selection.

In an example implementation, the software display driver 314 and/or the display driver circuitry 310 may be operable to dynamically determine a best mode for any particular pixel based on analysis of the pixel data itself, rather than explicit mode selection instructions. For example, if multiple frames of fields are buffered and inspected to determine that a pixel will be a fixed color (e.g., black or white where black and white particles are used) throughout those frames, then the reflective mode may be selected for that pixel and those frames. Conversely, if the pixel will be changing during those frames, an emissive mode may be selected for that pixel and those frames.

Figure 3B:
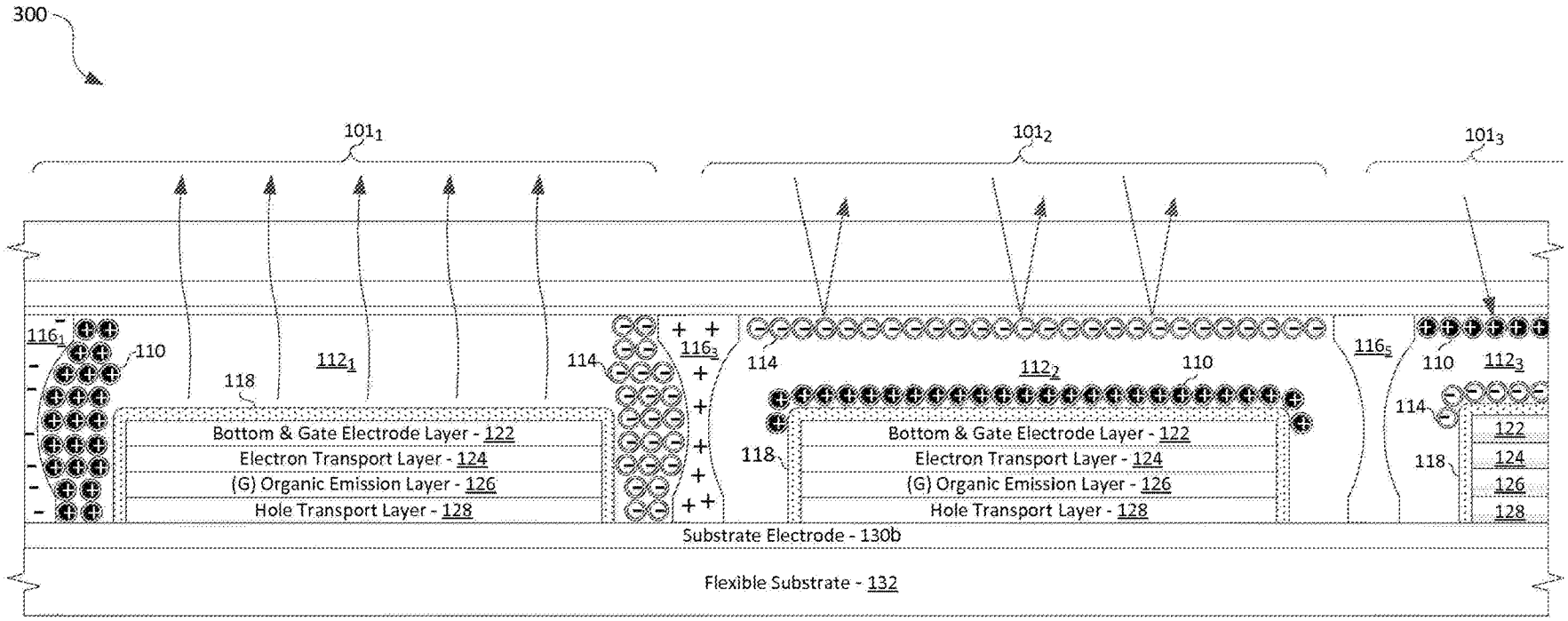

FIG. 3B shows a cross-section of a portion of a multimode display device 300 of FIG. 3A. Shown in FIG. 3B are two full pixels $\mathbf{101}_1$ and $\mathbf{101}_2$ and a partial pixel $\mathbf{101}_3$ of the display device 300. The subpixel $\mathbf{101}_1$ is operating in OLED mode, the pixels $\mathbf{101}_2$ and $\mathbf{101}_3$ are operating in EPD mode. Thus, the pixels shown in FIG. 3B may, for example, correspond to pixels on the left boundary of the OLED window 302 of FIG. 3A.

Figure 4:
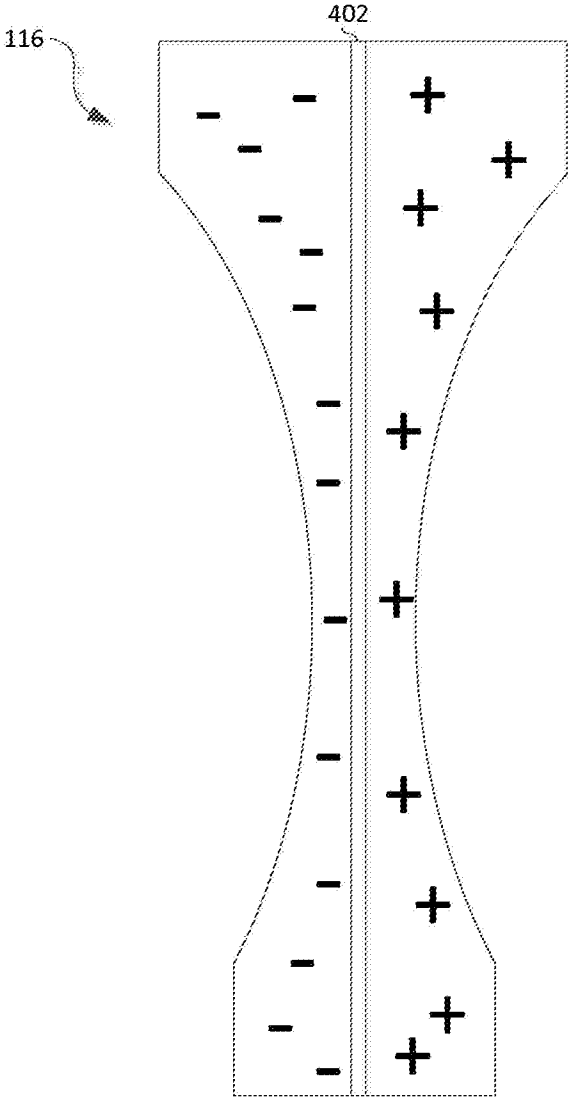
FIG. 4 illustrates an example pixel wall/divider that supports different charges on different sides.

FIG. 4 illustrates an example pixel wall/divider that supports different charges on different sides. In the scenario shown the left side of the wall is charged to a negative potential while the right side of the wall is charged to a positive potential, with an insulating layer 402 between them. The ability to independently control the two sides of the wall may aid in managing inter-pixel charge interactions (e.g., reduce the need for very careful control of various charges) at the expense of more complicated drive circuitry associated with the walls 116 (e.g., twice the number of TFT transistors for actively driven walls).

Similarly, although not shown, separate coatings can be added to the left side and right side to carry out the desired charge and voltage potential management, while still using a common and possibly insulating middle wall portion. For example, an insulating plastic might be used for the walls which have a transparent conductive left side coating and a transparent conductive right side coating that can be accessed by display driver circuitry to set operational modes.

Figure 5A:
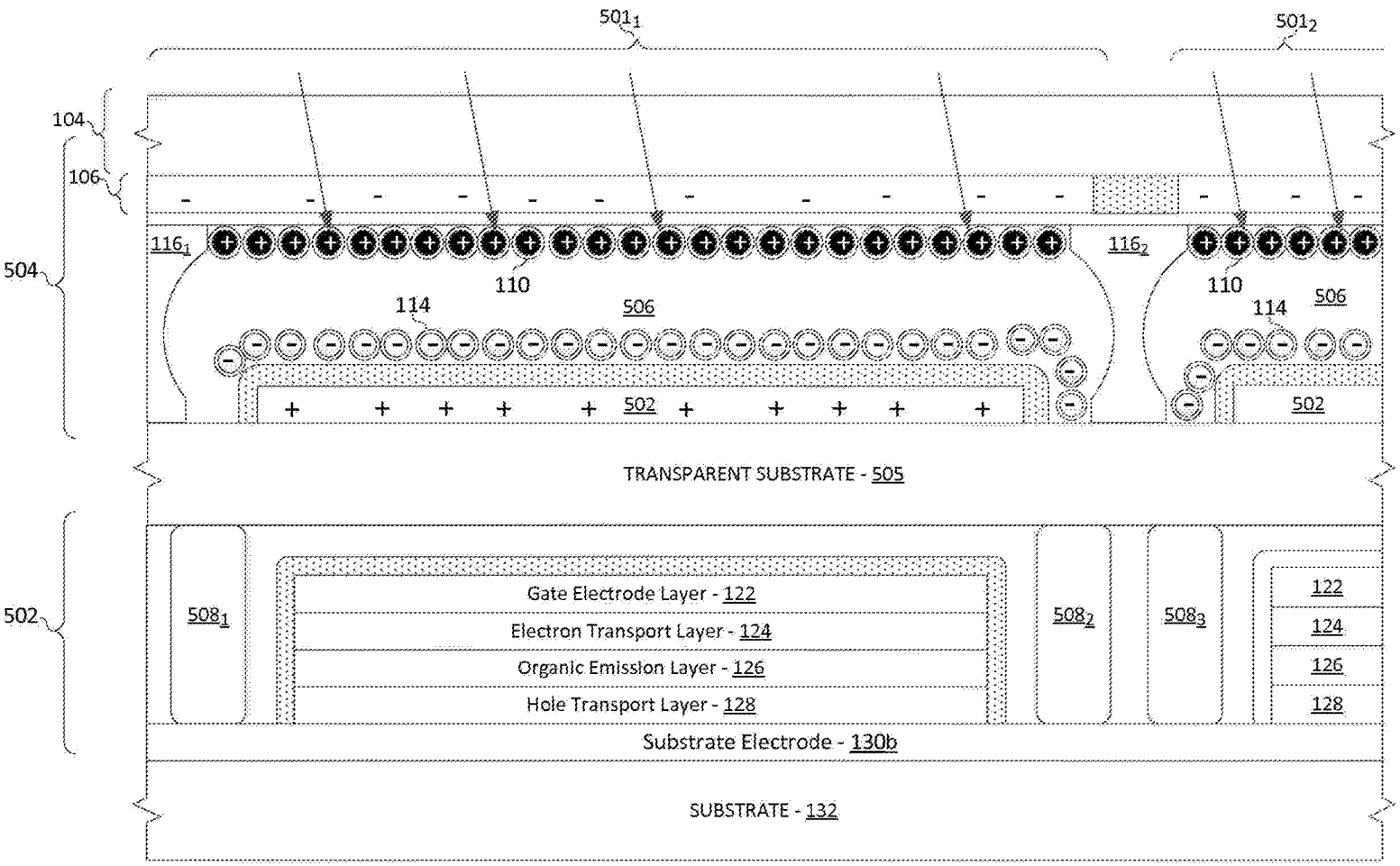
FIGS. 5A-5C depict a portion of an array of pixels of a sandwich-structured multimode electronic display.
Figure 5B:
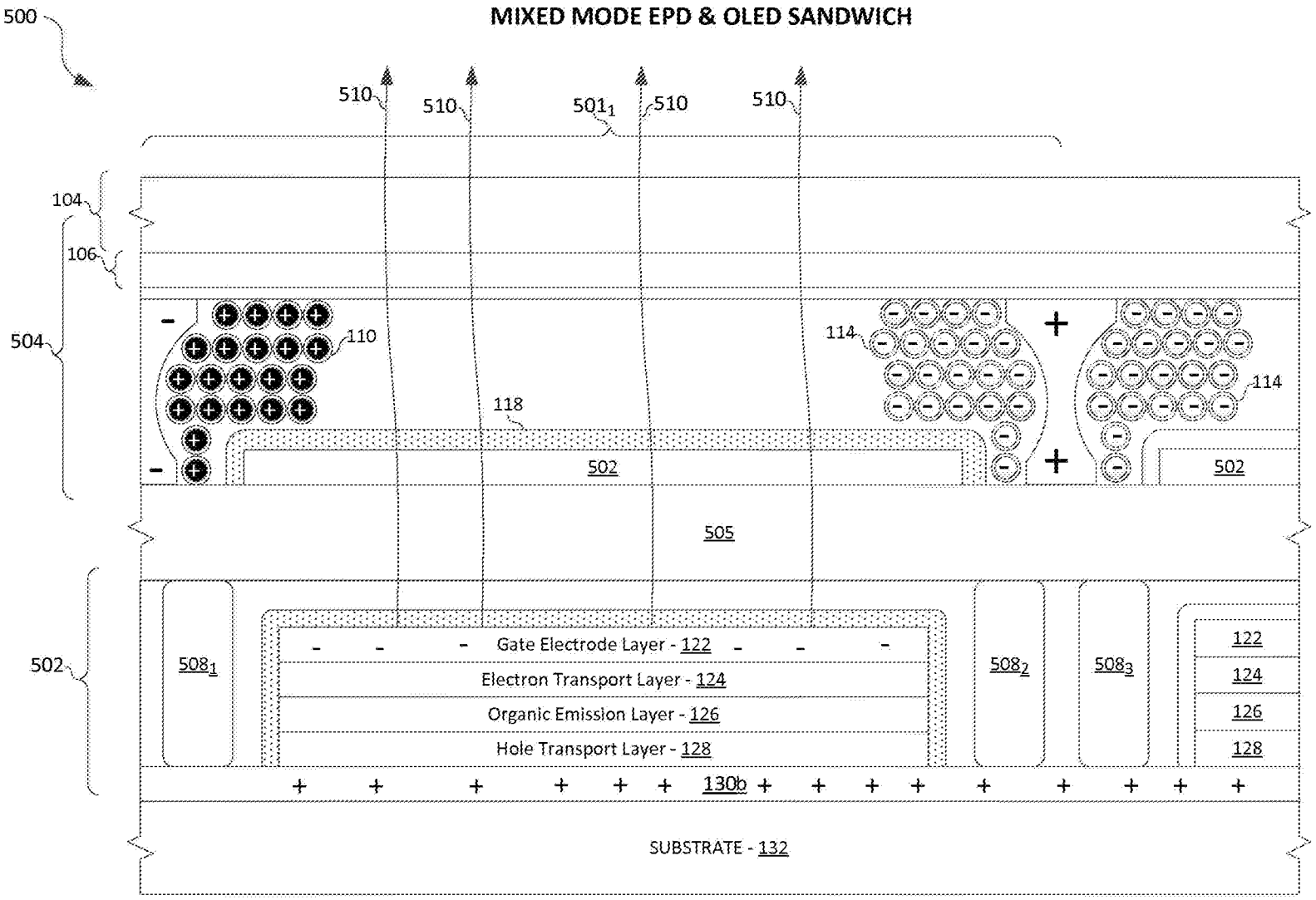

FIGS. 5A and 5B depict a portion of an array of pixels of a sandwich-structured multimode electronic display. A first subpixel $\mathbf{501}_1$ is completely shown and a portion of a second subpixel $\mathbf{501}_2$ is shown. Each pixel 501 of the array 500 comprises an OLED layer 502 below an EPD layer 504.

The EPD layer 504 comprises walls 116, particles 110 and 114, and top electrode 106 as discussed above. The EPD also comprises a transparent bottom electrode 502. A voltage differential established between the electrodes 106 and 502 controls whether the white particles 110 or black particles 114 are at the front of the cavity 506.

The OLED layer 502 comprises the OLED stack and electrode 130*b* as discussed above. The OLED layer 502 also comprises walls 508 which provide structural support but need not be conductive or be connected to drive circuitry, as compared to the walls 116.

In FIG. 5A, the pixels $\mathbf{501}_1$ and $\mathbf{501}_2$ are both in EPD mode. Accordingly, the OLED stack of each of the pixels $\mathbf{501}_1$ and $\mathbf{501}_2$ is off and the EPD layer 504 of each of the pixels $\mathbf{501}_1$ and $\mathbf{501}_2$ has appropriate biases established such that either black particles 110 (as shown), or the white particles 114, are drawn to the front of the cavity 506.

In FIG. 5B, pixels $\mathbf{501}_1$ and $\mathbf{501}_2$ are both in OLED mode. Accordingly, the particles 110 and 114 are pulled out of the way, and the OLED stack of each of the pixels $\mathbf{501}_1$ and $\mathbf{501}_2$ is on. Photons emitted by the OLED stack pass through the transparent gate electrode layer 122, the transparent middle substrate 505, the transparent bottom electrode 502, the transparent top electrode 106, and the transparent cover 104 (as represented by arrows 510).

Figure 5C:
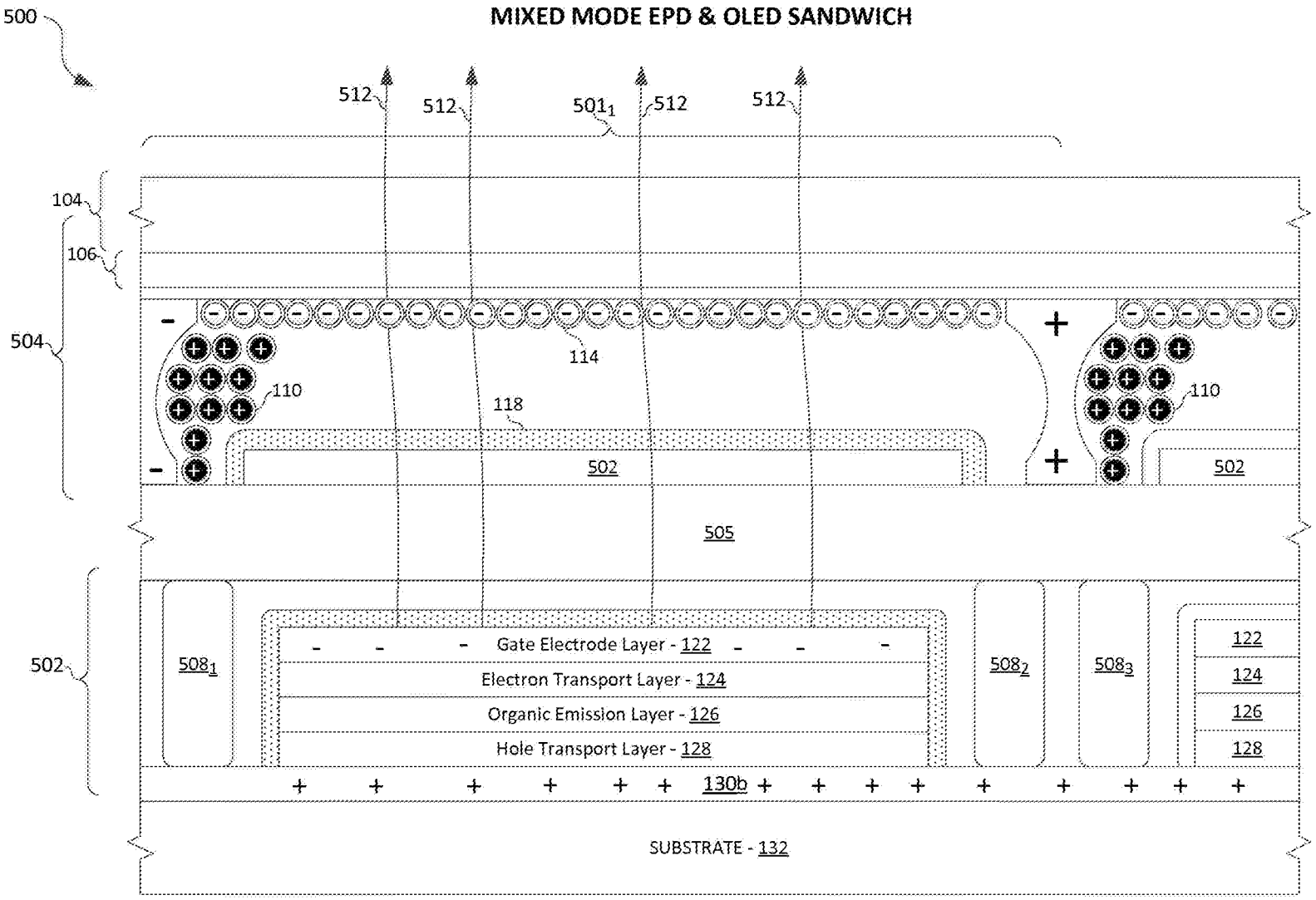

In FIG. 5C, pixels $\mathbf{501}_1$ and $\mathbf{501}_2$ are both in a hybrid OLED-EPD mode. Accordingly, particles 114, which are transparent or semi-transparent when illuminated from behind, are pulled to the top electrode 106 in the EPD layer 504 and emitted photons from the OLED stack pass through the particles, as represented by arrows 512.

Although each of FIGS. 5A-5C depicts both pixels $\mathbf{501}_1$ and $\mathbf{501}_2$ operating in the same mode, the two pixels $\mathbf{501}_1$ and $\mathbf{501}_2$ may concurrently operate in any combination of two of the three modes.

Figure 6A:
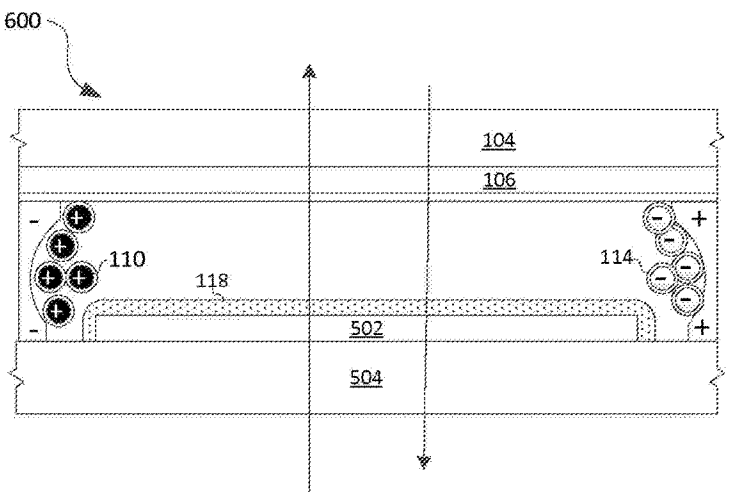
FIGS. 6A-6D depict an absorptive/reflective display supporting, transparent, reflective, and absorptive modes.
Figure 6B:
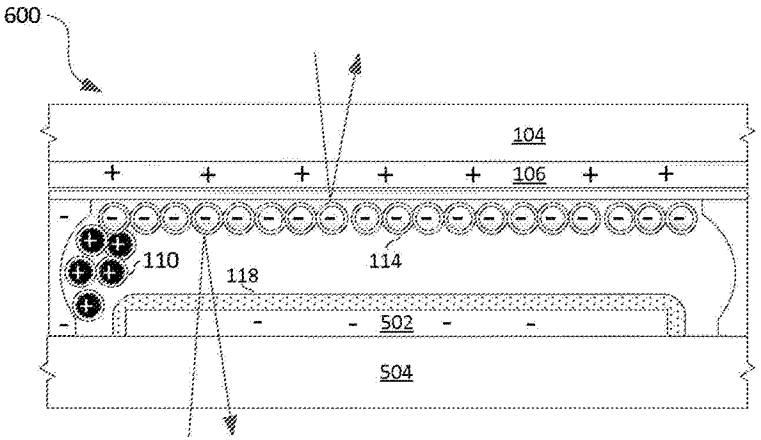
Figure 6C:
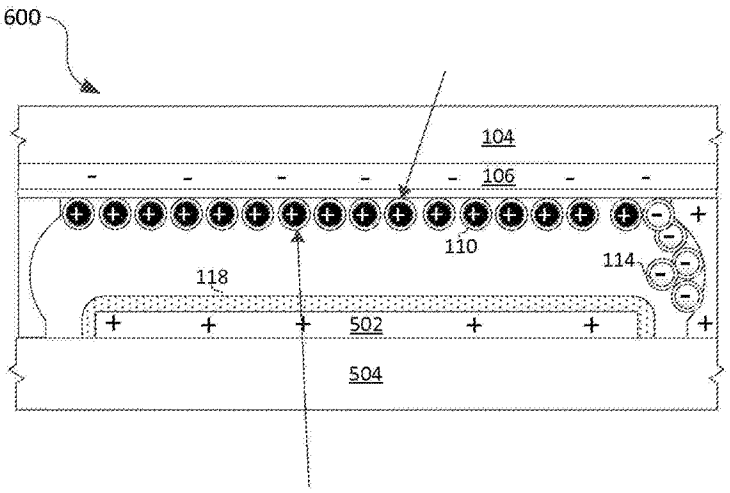

FIGS. 6A-6D depict an absorptive/reflective display supporting, transparent, reflective, and absorptive modes. Shown in each of FIGS. 6A-6D is a cross-section of a pixel of an EPD display 600. The layers of the display 600 are the same as those of the EPD layer 504 described with reference to FIGS. 5A-5C. Drive signals applied to the top electrode 106, the bottom electrode 502, and the walls 116 control selection between five configurations: (1) a transparent configuration (FIG. 6A); (2) both sides white/reflective configuration (FIG. 6B); (3) both sides black/absorptive configuration (FIG. 6C); (4) a first side white/reflective and second side black/absorptive configuration (FIG. 6D); and (5) a first side black/absorptive and second side white/reflective configuration (same as FIG. 6D, but with voltage across 106 and 502 reversed).

In the configuration of FIG. 6A, the drive signals to the electrode 106, electrode 502, and walls 116 are controlled to hide both white particles 114 and black particles 110 into cavities in the walls 116. The pixel is perceived as transparent.

In the configuration of FIG. 6B, the drive signals to the electrode 106, electrode 502, and walls 116 are controlled to pull the white particles 114 to the top electrode 106 while keeping the black particles 110 hidden in the cavities in the walls 116. The pixel is perceived as white from both the front and back.

In the configuration of FIG. 6C, the drive signals to the electrode 106, electrode 502, and walls 116 are controlled to pull the black particles 110 to the top electrode 106 while keeping the white particles 114 hidden in the cavities of the walls 116. The pixel is perceived as black from both front and back.

Figure 6D:
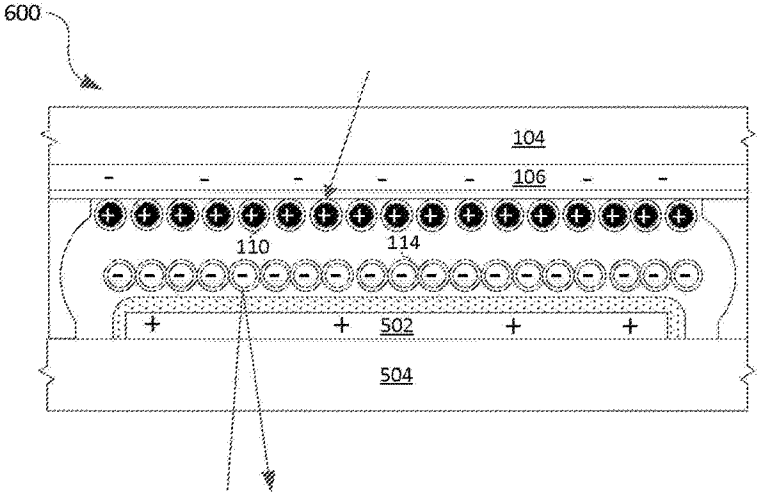

In the configuration of FIG. 6D, the drive signals to the electrode 106, electrode 502, and walls 116 are controlled to pull the black particles 110 to the top electrode 106 and white to the bottom electrode 502. The pixel is perceived as black from the front and white from the back.

In the fifth configuration (not shown), the drive signals to the electrode 106, electrode 502, and walls 116 are controlled to pull the white particles 114 to the top electrode 106 and black particles 110 to the bottom electrode 502. The pixel is perceived as white from the front and black from the back.

Figure 7A:
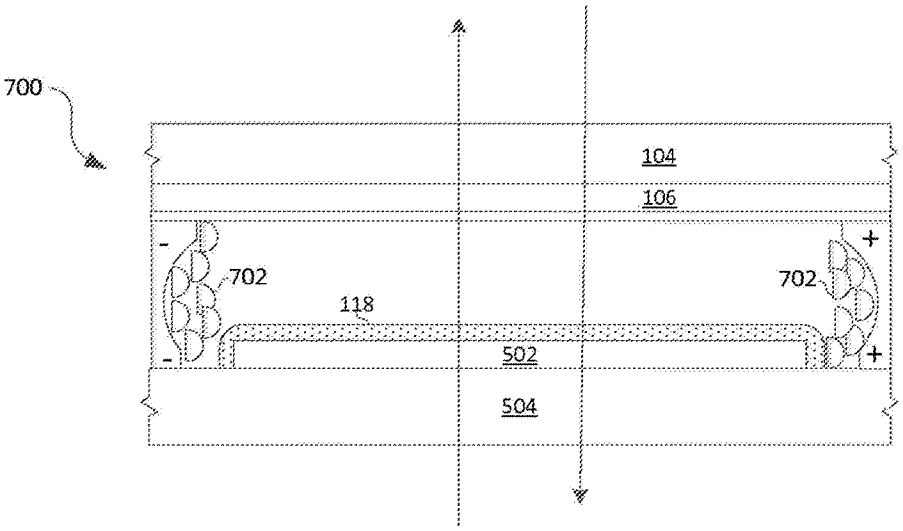
FIGS. 7A-7C depict an absorptive/reflective display supporting two-way and one-way transparency.
Figure 7C:
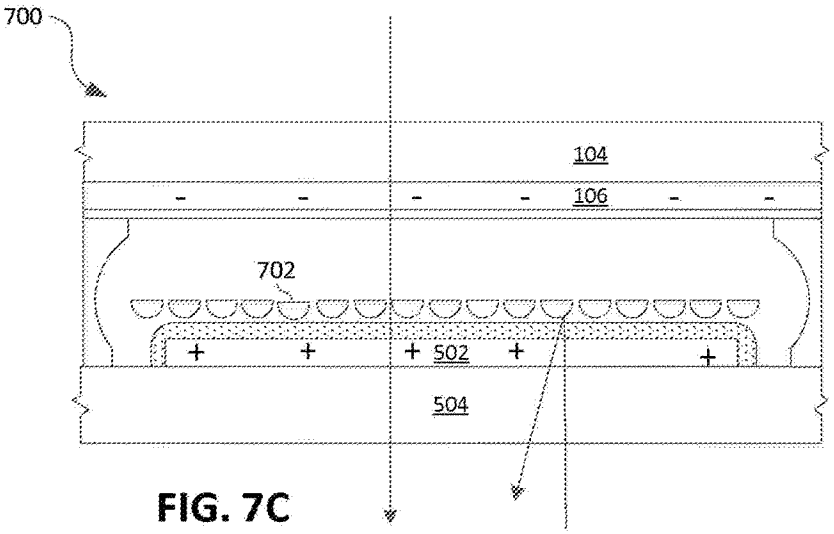
Figure 7B:
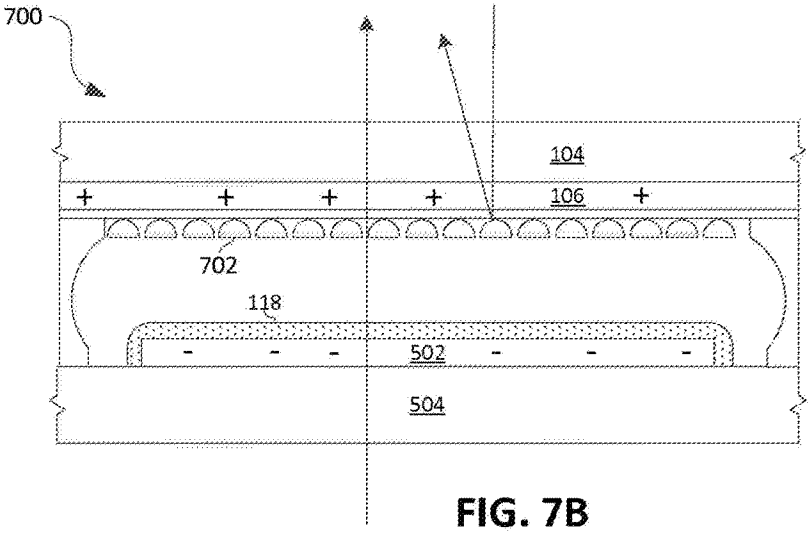

FIGS. 7A-7C depict an absorptive/reflective display supporting two-way and one-way transparency. The display 700 shown is similar to the display 600 but comprises bistable, one-way transparent particles 702 instead of particles 110 and 114.

When charge is applied to the walls 116, the particles are pulled out of the line of sight and the display is transparent in both directions (FIG. 7A). When a charge of a first polarity is applied, the display 700 is transparent in a first direction and opaque a second direction (FIG. 7B). When a charge of a second polarity is applied, the display 700 is opaque in the first direction and transparent in the second direction (FIG. 7C).

Although EPD and OLED are used for illustration of the multimode display disclosed herein, other modes are possible. For example, a multimode display may support an OLED mode and a liquid crystal display (LCD) mode and another multimode display may support a EPD mode and an LCD mode. In this regard, for a display supporting an LCD mode, integration, regional backlighting may be carried out with a backlighting array to support regional mode operations.

In addition, various other ways to integrate (via stacking or merging) two or more display technologies are contemplated. For example, any emissive display technology can be integrated (merged or stacked) with any non-emissive display technology as suggested in prior embodiments. Multiple of either emissive or non-emissive display technology might also undergo such integration. For example, a single display panel might be constructed using the display portion shown in FIG. 7A with an LCD display stacked there upon or merged therein.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Accordingly, the present invention may be realized in hardware or a combination of hardware and software. The present invention may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip. Some implementations may comprise a non-transitory computer readable medium and/or storage medium, and/or a non-transitory machine readable medium and/or storage medium, having stored thereon, code executable by a machine, thereby causing the machine to realize the systems and/or perform the processes described herein.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. A system comprising:

a first display driver interface circuit configured to receive a plurality of software control instructions regarding a display device;

a second display driver interface circuit configured to deliver a first control signal to a display device in response to a first of the plurality of software control instructions, and to deliver a second control signal to the display device in response to a second of the plurality of software control instructions, wherein the first control signal directs at least a portion of the display device into a light emitting mode when pixel data to be displayed by that portion of the display device is variable over a determined number of consecutive frames, and the second control signal directs at least a portion of the display device into an electronic paper mode when pixel data to be displayed by that portion of the display device is fixed over the determined number of consecutive frames; and processing circuitry configured to:

buffer the determined number of consecutive frames of pixel data;

inspect the buffered pixel data to determine whether the pixel data is static or variable over the buffered frames; and generate the first of the software control instructions and the second of the software control instructions based on the results of the inspection.

2. The system of claim 1, wherein:

the first of the plurality of software control instructions includes an emissive mode selection identifier; and the second of the plurality of software control instructions including a reflective mode selection identifier.

3. The system of claim 1, wherein the second interface is configured to deliver the first control signal and the second control signal during a vertical blanking interval.

4. The system of claim 1, comprising the display device, wherein the display device comprises a plurality of pixels configurable into both the light emitting mode and the electronic paper mode.

5. The system of claim 4, wherein:

each of the plurality of pixels comprises an organic light emitting diode (OLED) stack protruding into a fluid filled cavity in which a plurality of charged particles for implementing the emissive mode are suspended;

the fluid filled cavity of each of the plurality of pixels is formed between a pair of top and bottom electrodes, and a pair of wall electrodes on the walls that separate the plurality of pixels; and the OLED stack is controlled via a voltage present between the bottom electrode and a gate electrode interposed between the top and bottom electrodes.

6. The system of claim 4, wherein the first control signal and the second control signal control a voltage of each of the top, bottom, and wall electrodes.

7. The system of claim 6, wherein the top electrode is at least semi-transparent such that light emitted from the OLED stack can pass through the first electrode when the display device is in the light emitting mode.

8. The system of claim 5, wherein the walls comprise cavities in which particles used for the reflective mode can be stored out of the path of light from the OLED stack while in the light emitting mode.

9. The system of claim 5, wherein the particles include first particles of a first color and first charge and second particles of a second color and second charge such that each of the plurality of pixels is configurable into at least three modes: a first-color reflective mode, a second-color reflective mode, and an emissive mode.

10. A method comprising:

receiving, by a first display driver interface circuit, a plurality of software control instructions regarding a display device;

delivering, by a second display driver interface circuit, a first control signal to the display device in response to a first of the plurality of software control instructions, and a second control signal to the display device in response to a second of the plurality of software control instructions, wherein the first control signal directs at least a portion of the display device into a light emitting mode when pixel data to be displayed by that portion of the display device is variable over a determined number of consecutive frames, and the second control signal directs at least a portion of the display device into an electronic paper mode when pixel data to be displayed by that portion of the display device is fixed over the determined number of consecutive frames;

buffering, by processing circuitry, the determined number of consecutive frames of pixel data;

inspecting, by the processing circuitry, the buffered pixel data to determine whether the pixel data is static or variable over the buffered frames; and generating, by the processing circuitry, the first of the software control instructions and the second of the software control instructions based on the results of the inspection.

11. The method of claim 10, wherein:

the first of the plurality of software control instructions includes an emissive mode selection identifier; and the second of the plurality of software control instructions including a reflective mode selection identifier.

12. The method of claim 10, wherein the first control signal and the second control signal are delivered during a vertical blanking interval.

13. A method comprising:

receiving, by a first display driver interface circuit, a plurality of software control instructions regarding a display device;

delivering, by a second display driver interface circuit, a first control signal to the display device in response to a first of the plurality of software control instructions, and a second control signal to the display device in response to a second of the plurality of software control instructions, wherein the first control signal directs at least a portion of the display device into a light emitting mode when pixel data to be displayed by that portion of the display device is variable over a determined number of consecutive frames, and the second control signal directs at least a portion of the display device into an electronic paper mode when pixel data to be displayed by that portion of the display device is fixed over the determined number of consecutive frames, wherein the first control signal and the second control signal control voltages applied to electrodes adjacent to a fluid filled cavity in which charged particles are suspended and into which an OLED stack protrudes.

14. The method of claim 13, comprising:

buffering, by processing circuitry, the determined number of consecutive frames of pixel data;

inspecting, by the processing circuitry, the buffered pixel data to determine whether the pixel data is static or variable over the buffered frames; and generating, by the processing circuitry, the first of the software control instructions and the second of the software control instructions based on the results of the inspection.

15. The method of claim 13, wherein:

the first of the plurality of software control instructions includes an emissive mode selection identifier; and the second of the plurality of software control instructions including a reflective mode selection identifier.

16. The method of claim 13, wherein the first control signal and the second control signal are delivered during a vertical blanking interval.

* * * * *